US008333153B2

(12) United States Patent
Caillat

(10) Patent No.: US 8,333,153 B2
(45) Date of Patent: Dec. 18, 2012

(54) LAUNCHING DEVICES ENABLING SUB-CALIBER ARTILLERY PROJECTILES

(75) Inventor: Lionel Caillat, Bigny-Vallenay (FR)

(73) Assignee: Nexter Munitions, Versailles (FR)

( * ) Notice: Subject to any disclaimer, the term of this patent is extended or adjusted under 35 U.S.C. 154(b) by 62 days.

(21) Appl. No.: 12/957,939

(22) Filed: Dec. 1, 2010

(65) Prior Publication Data

US 2011/0146525 A1 Jun. 23, 2011

(30) Foreign Application Priority Data

Dec. 21, 2009 (FR) ..... 09 06206

(51) Int. Cl.
*F42B 14/06* (2006.01)

(52) U.S. Cl. ..... 102/522; 102/520; 102/526

(58) Field of Classification Search ..... 102/520, 102/521, 522, 523, 526
See application file for complete search history.

(56) References Cited

U.S. PATENT DOCUMENTS 4,419,796 A 12/1983 Broden et al.
4,476,785 A 10/1984 Hoffman et al.
4,841,867 A * 6/1989 Garrett ..... 102/520
5,052,305 A * 10/1991 Chiarelli et al. ..... 102/522
5,392,714 A 2/1995 Bilgeri
5,493,974 A * 2/1996 Bilgeri ..... 102/522
5,969,289 A * 10/1999 Bisping et al. ..... 102/521
6,129,024 A * 10/2000 Gerber et al. ..... 102/521
6,234,082 B1 5/2001 Cros et al.

FOREIGN PATENT DOCUMENTS

DE 1 262 830 B 3/1968
EP 0 905 473 A1 3/1999
GB 123501 2/1919
WO WO 93/02333 A1 2/1993

OTHER PUBLICATIONS

French Search Report issued in Application No. 09 06206; Dated Jul. 13, 2010 (With Translation).

* cited by examiner

*Primary Examiner* — James Bergin
(74) *Attorney, Agent, or Firm* — Oliff & Berridge, PLC

(57) ABSTRACT

The invention relates to a launching device for a sub-caliber artillery projectile employing a base with sliding band, the base being linked to sabot sectors by means of hinges that can be detached during flight, the opening of the sabot being activated thanks to the dynamic air pressure on the flared shapes to the fore of the sectors, said hinge is flanged radially so as to prevent its becoming separated from the sabot sectors 5 outside of the flight phase.

9 Claims, 6 Drawing Sheets

LAUNCHING DEVICES ENABLING SUB-CALIBER ARTILLERY PROJECTILES

BACKGROUND OF THE INVENTION

1. Field of the Invention

The technical scope of the invention is that of launching devices enabling sub-caliber artillery projectiles to be fired from a gun barrel.

2. Description of the Related Art

So as to improve the range of large caliber artillery projectiles, it is possible to employ projectiles that have lift surfaces such as fins and to combine such means with the sub-calibration of the projectile so as to reduce its aerodynamic drag.

These solutions firstly require the use of uncoupling means between the projectile and the weapon so that the spin effect created by the gun barrel does not damage the projectile fins and secondly the use of means to compensate for the difference in caliber between the projectile and the barrel.

Upon exiting the barrel, these means having performed their functions, it is necessary for them to be discarded from the projectile without this hindering or perturbing the projectile's trajectory.

For this, it is known by document EP-0905473 to employ a sliding band around a base pushing the projectile. This base is separated from the projectile by means of a small pyrotechnic ejector. Independently from the ejection of the base, the caliber compensation means, also called sabot sectors, placed to the fore of the projectile are distanced from the projectile by the dynamic air pressure.

The solution using the pyrotechnic ejector is complicated since firing must be performed precisely and reliably. The impulsion of the ejector can perturb the projectile's trajectory if this impulsion is not perfectly coaxial to the trajectory. Furthermore, retaining the sabot sectors on the projectile requires machining to be performed on the projectile to be able to install pins that are sectioned upon firing. These pins need to be precisely calibrated for fracture.

Medium-caliber sub-caliber projectiles are known that incorporate a sabot integral with a base and which opens upon exiting the gun barrel through the effect of the centrifugal force. Such projectiles are disclosed, for example, by U.S. Pat. No. 4,419,796, DE-1262830 and U.S. Pat. No. 4,476,785.

These sabots are generally integral with the base and incorporate incipient fractures to facilitate the release of the projectile. Such solutions cannot be transposed to an artillery projectile whose spin is reduced by the effect of the sliding band.

A medium-caliber dart-type projectile is also known by patent WO93/02333 that is released by a sabot integral with a base. The solution proposed implements an embrittled hinge that fractures upon exiting the gun barrel. Such a solution is likely to perturb the trajectory of an artillery projectile.

Patent GB-123501 succinctly describes a sub-caliber projectile of large caliber (406 mm) wherein its sabot sectors are hinged to the base. These hinges are opened through the action of the centrifugal force. However, these hinges are not clearly defined by this patent. These hinges enable the base to be pushed rearwards out of the way of the projectile. It even seems that the sectors remain integral with the base by their hinges as suggested in FIG. 3.

This solution can not be transposed to an artillery projectile equipped with a sliding band and for which the centrifugal force is reduced and for which there is a high risk of perturbation of the projectile's flight linked to dissymmetry in opening the sabot segments.

SUMMARY OF THE INVENTION

The invention proposes to improve the release of the projectile by linking the sabot sectors to the base by a hinge having a specific geometry that does not cause interference between the sabot sectors and the base. In this way, the sectors are distanced symmetrically so as to avoid perturbing the projectile's trajectory and the base is furthermore distanced from the projectile by the pressure of the sectors on the base combined with the load created by its own aerodynamic drag.

In this simple manner, no parasitic stress is applied to the projectile.

Thus, the invention relates to a launching device for a sub-caliber artillery projectile, launching device comprising a base at its rear part that incorporates a sliding band at its periphery, base containing a rear part of the projectile and incorporating a thrust surface cooperating with a matching surface at the rear of the projectile, launching device wherein it comprises at least two cylinder sectors surrounding the projectile and intended to ensure guidance by means of exterior ring-shaped support bands, sectors in contact by at least one interior support shape with the projectile, launching device incorporating for each sector at least one hinge materializing an instantaneous axis, hinge able to be detached during flight and linking the base to the sector in question, the hinge being constituted by at least one notch on the base which cooperates with a tooth linked to the sector, the notch being delimited to the fore by a plane inclined surface and to the rear by a stop surface perpendicular to the projectile's longitudinal axis and cooperating with a matching support surface on the tooth, an edge of the tooth being in contact with the stop surface and constituting the instantaneous axis, the tooth and notch having, furthermore, a geometry such that the tooth pivots when the sector opens around the instantaneous axis without interfering with the inclined surface.

According to one embodiment of the invention, the notch incorporates an inclined surface forming an angle $\alpha$ greater than or equal to 90 degrees with a fictive plane F passing by the instantaneous axis and by a point of contact between the tooth and the inclined surface, any part of the tooth placed between the fictive plane F and the stop surface being located at a distance from the instantaneous axis that is less than the distance separating the latter axis and the point of contact between the tooth and the inclined surface.

According to another characteristic of the invention, the hinge may incorporate at least one means to adjust the axial pressure play between the base and the sector.

These means to adjust the axial pressure play may comprise at least one pressure screw at each hinge integral by an internal thread in the tooth and pressing on the inclined surface of the notch.

According to another characteristic of the invention, the device may incorporate at least one flange means to oppose the radial distancing between the base and the sectors when these are in contact with the projectile.

These flange means may thus incorporate at least one flange screw at each hinge that passes through the tooth by means of internal threading, such flange screw being oriented so as to penetrate to the rear of the launching device and into a recess made in the notch in the base, recess in contact with the flange screw so as to prevent any radial movement of the tooth with respect to the base.

The surfaces of the recess will be selected with dimensions such that they do not interfere with the flange screw when this rotates around the instantaneous axis in the direction of opening of the sectors.

BRIEF DESCRIPTION OF THE DRAWINGS

The description given hereafter, illustrated by the appended drawings, will enable the invention to be better understood.

DETAILED DESCRIPTION OF PREFERRED EMBODIMENTS

Figure 1:
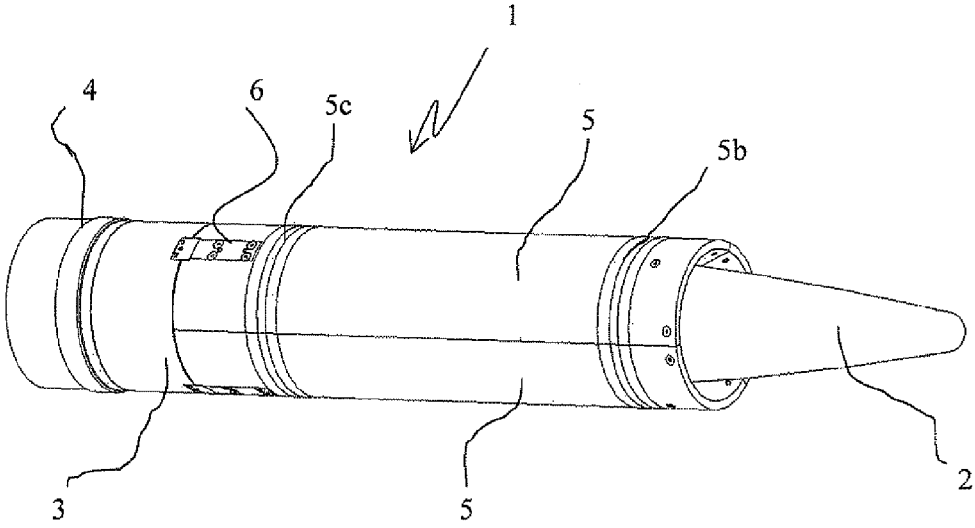
FIG. 1 shows a launching device containing a projectile.

According to FIG. 1 and according to one embodiment, the launching device 1 contains a projectile 2. This device is formed of a base 3 on its rear part. The base is equipped with a sliding band 4. The base is linked to three sectors 5 forming a sabot, only two of which can be seen in the drawing. The link is ensured by a hinge 6 between each sector 5 of the sabot and the base 3. The external part of the sabot sectors 5 is in contact with the interior of the gun barrel thanks to bands 5*b*, 5*c* forming ring-shaped seats (bands made, for example, of a plastic material).

The device such as shown in this drawing is in the configuration it occupies once put in place in the gun chamber and over all its trajectory in the gun barrel.

Figure 2:
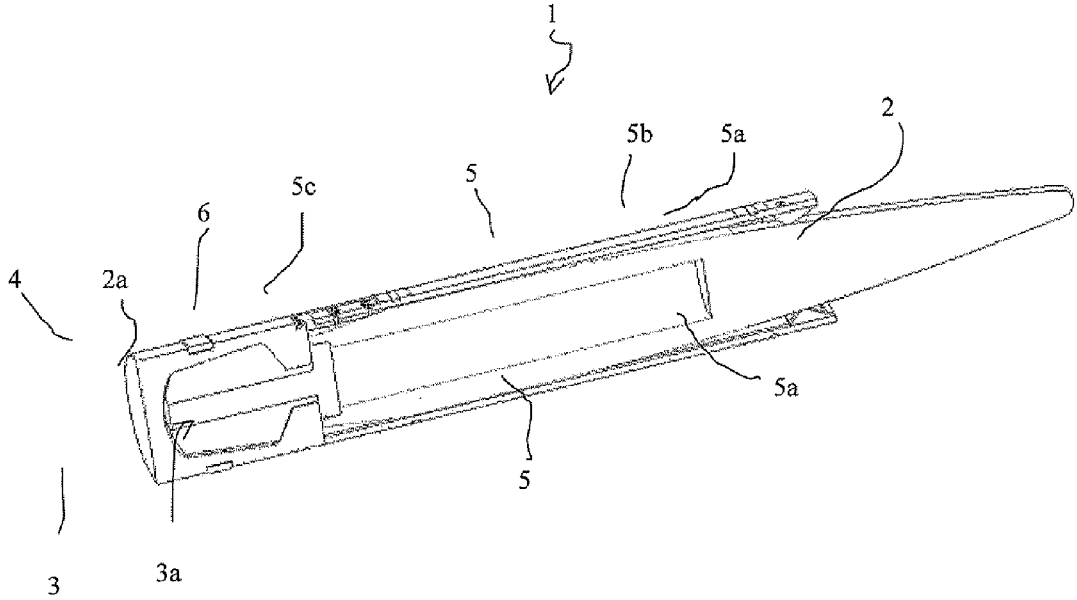
FIG. 2 shows a longitudinal section view of a launching device containing a projectile.

According to FIG. 2, the fins 2*a* of the projectile 2 are contained in the base 3. The base 3 incorporates a thrust surface 3*a* pressing on a matching rear surface of the projectile 2. The base 3 has grooves, not shown, opening out into this thrust surface 3*a* so as to allow the fins 2*a* to pass when the base 3 separates from the projectile 2. The sabot sectors 5 incorporate flared interior support shapes 5*a* in contact with the projectile 2 to centre it on the longitudinal axis of the launching device.

Figure 3:
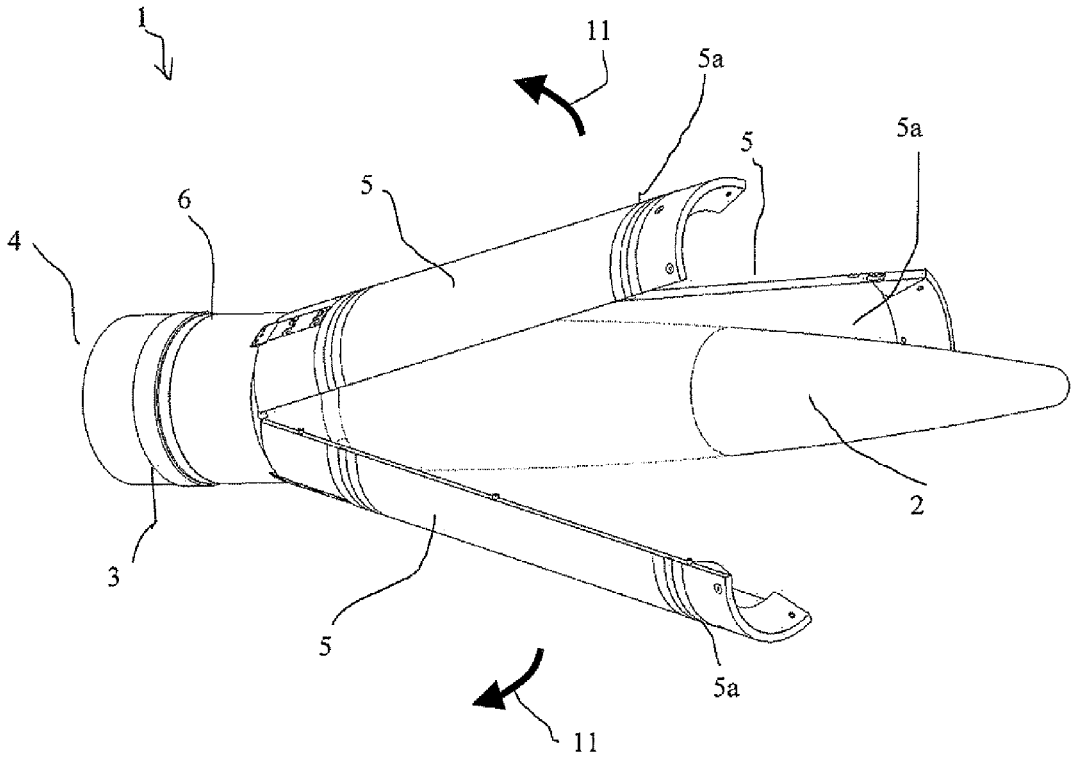
FIG. 3 shows a launching device containing a projectile when the device separates from the projectile.

According to FIG. 3, directly upon exiting the barrel, the device 1 will open as follows. The air pressure exerted on the flared support shapes 5*a* of each sector 5 will cause a symmetrical distancing (arrows 11) of the sectors 5 with fracturing of the ring-shaped seats 5*b* and 5*c*. These sectors 5 pressing on the base 3 by means of the hinges 6 will push the base 3 rearwards, bringing it to distance itself from the rear of the projectile 2 and thus freeing the fins 2*a*. Throughout this phase, there is no radial load exerted on the projectile 2. Following this phase, the hinges 6 (which are not integral with the base) will detach from the base 3 and each piece of the device 1 will be projected away from the trajectory of the projectile 2.

Figure 4:
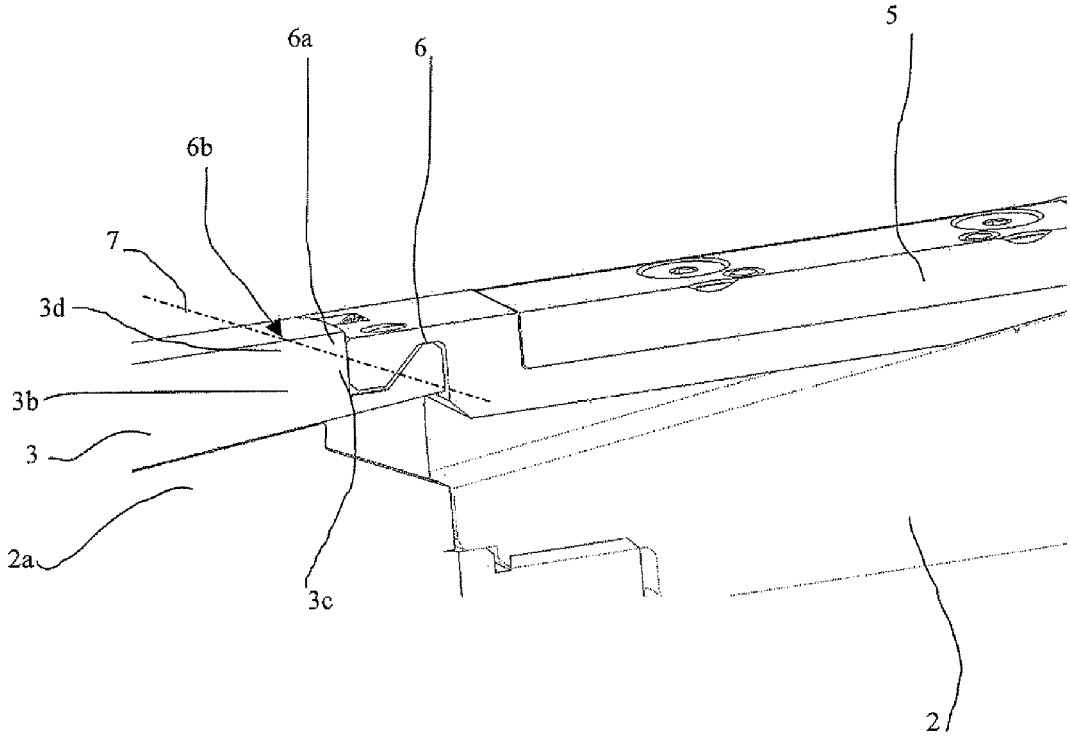
FIG. 4 shows a detailed section view of the hinging of the launching device, such longitudinal section made between the screws.

According to FIG. 4, each hinge 6 comprises a tooth 6*a* inserted in a matching notch 3*b* made in the base 3. The notch 3*b*, of a width substantially equal to the width of the tooth 6*a*, is delimited to the fore by an inclined plane surface 3*c* and to the rear by a surface 3*d*, a so-called stop surface, perpendicular to the longitudinal axis of the launching device 1.

The tooth 6*a* incorporates an edge 6*b* at its foot positioned to the rear of the device. This edge 6*b* in contact with the stop surface 3*d* constitutes an instantaneous axis 7 for the tooth 6*a* when the sector 5 opens.

Figure 5:
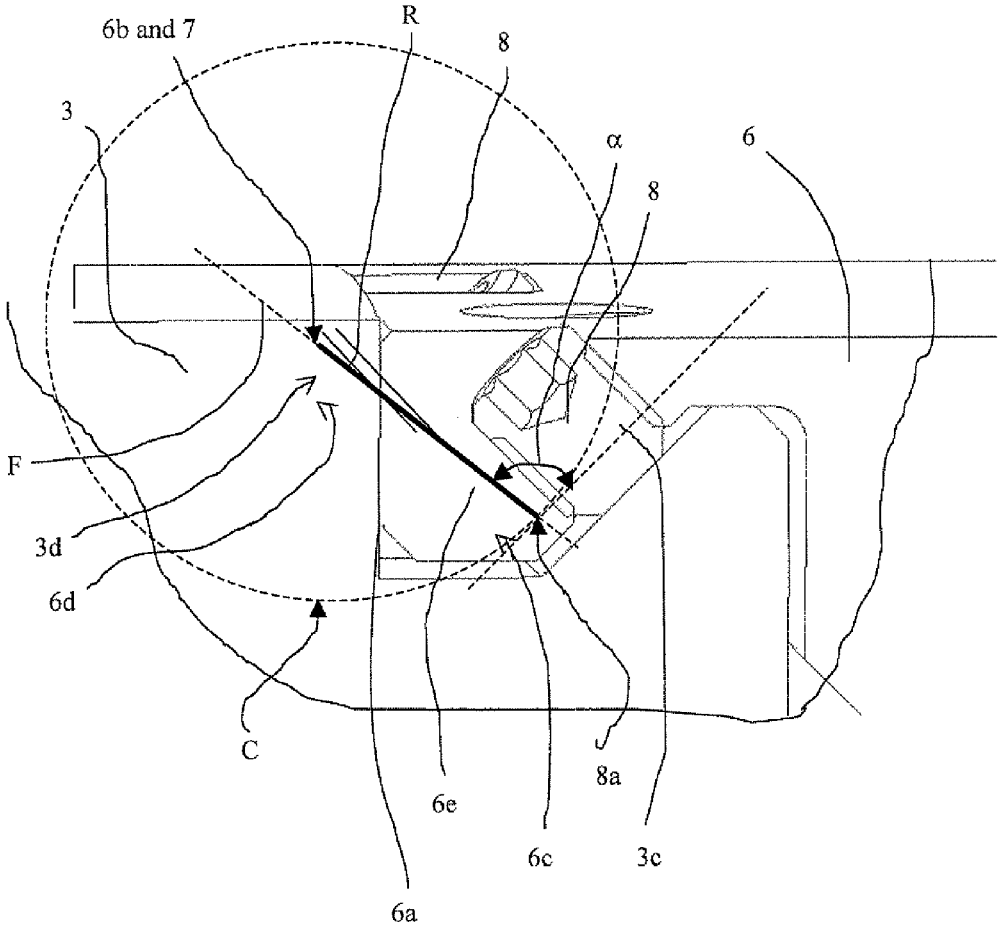
FIG. 5 shows a detailed section view of the means to adjust the axial play between the base and the sector, such longitudinal section made at a pressure screw.

According to FIG. 5, two pressure screws 8, passing through the tooth 6*a* via internal threading 6*e*, by tightening enable pressure to be put on the inclined surface 3*c*, thereby bringing the surface 6*d*, perpendicular to the longitudinal axis of the projectile 2, into contact with the stop surface 3*d* of the base 3 to ensure the transmissions of the firing stresses from the base 3 to the sector 5. The hinge has a surface 6*c*.

A fictive plane F has been shown in this Figure in dotted lines passing through the instantaneous axis 7 (constituted by the edge 6*b*) and by the point of contact 8*a* between the pressure screw 8 and the inclined plane 3*c*. Similarly, in the longitudinal plane of the launching device, a circle C has also been shown in this Figure centered on the instantaneous axis 7 with a radius R equal to the distance between the instantaneous axis 7 and the point of contact 8*a* between the pressure screw 8 and the inclined plane 3*c*.

To avoid any interference between the tooth 6*a* or the pressure screws 8 and the inclined surface 3*c* of the notch 3*b* during the rotation around the instantaneous axis 7, two conditions must be met:

The angle $\alpha$ formed by the fictive plane F and the inclined plane 3*c* must not be less than 90 degrees.

The whole of that part of the tooth 6*a*, including the screw 8, placed between the fictive plane F and the support surface 6*d* must lie within the circle C.

In other words, any part of the tooth located behind the plane F must be at a distance that is less than R from the instantaneous axis 7.

Figure 6:
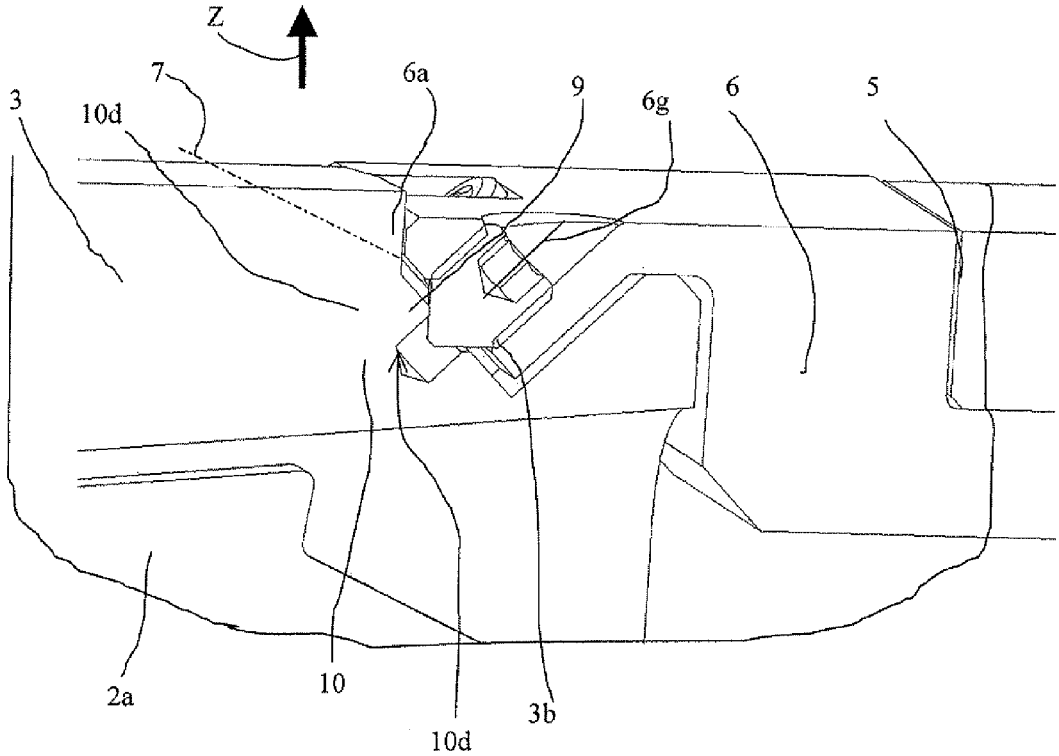
FIG. 6 shows a detailed section view of the flange means of the hinge, longitudinal section made at a flange screw.

According to FIG. 6, a setscrew 9 (or flange screw) is inclined such that it has a penetration angle oriented towards the rear of the launching device 1. This flange screw passes through the tooth 6 by means of an internal threading 6*g* and penetrates a cylindrical recess 10. This flange screw 9 will ensure a flanging function by penetrating in the recess 10 until it comes into contact with the chamfer 10*d* of the recess 10 but only on that part of the chamfer 10*d* oriented the most rearwards of the launching device 1 (upper part of the recess 10 shown in FIG. 6). The interference between the flange screw 9 and the chamfer 10*d* does not enable the tooth 6*a* to distance itself radially from the base 3 in direction Z.

The recess 10 is selected with a diameter large enough for it not to interfere with the screw 9 during the rotation of the tooth 6*a* around the instantaneous axis 7 due to the opening of sectors 5.

According to another embodiment, the recess 10 may be an oblong groove.

What is claimed is:

1. A launching device for a sub-caliber artillery projectile, said launching device comprising:

a base that incorporates a sliding band at the periphery of a projectile, said base containing a rear part of said projectile and incorporating a thrust surface cooperating with a matching surface at the rear of said projectile;

at least two cylinder sectors surrounding said projectile to ensure guidance by means of exterior ring-shaped support bands, said sectors being in contact by at least one interior support shape with said projectile; and said cylinder sectors including:

at least one hinge materializing an instantaneous axis, said hinge being detachable during flight, said hinge linking said base to one of said cylinder sectors, said hinge including:

at least one notch on said base, said notch being delimited to the fore by a plane inclined surface and to the rear by a stop surface perpendicular to the longitudinal axis of said projectile, and at least one tooth linked to one of said sectors, wherein said notch cooperating with a matching support surface on said tooth, an edge of said tooth being in contact with said stop surface and constituting said instantaneous axis, said tooth and said notch having a geometry such that said tooth pivots when one of said sectors opens around said instantaneous axis without interfering with said inclined surface.

2. The launching device according to claim 1, wherein said notch includes an inclined surface forming an angle ($\alpha$) greater than or equal to 90 degrees with a fictive plane (F) passing through said instantaneous axis and through a point of contact between said tooth and said inclined surface, any part of said tooth placed between said fictive plane F and said stop surface being located at a distance from said instantaneous axis that is less than the distance separating said instantaneous axis and the point of contact between said tooth and said inclined surface.

3. The launching device according to claim 2, wherein said hinge incorporates at least one means to adjust the axial pressure play between said base and said sector.

4. The launching device according to claim 1, wherein said hinge incorporates at least one means to adjust the axial pressure play between said base and said sectors.

5. The launching device according to claim 4, wherein the means to adjust said axial pressure play including at least one pressure screw at each hinge formed through an internal thread in said tooth and pressing on said inclined surface of said notch.

6. The launching device according to claim 5, the launching device further comprising:

at least one flange means for said hinge to oppose the radial distancing between said base and said sectors when said base and said sectors are in contact with said projectile.

7. The launching device according to claim 1, the launching device further comprising:

at least one flange means for said hinge to oppose the radial distancing between said base and said sectors when said sectors are in contact with said projectile.

8. The launching device according to claim 7, wherein said flange means includes at least one flange screw in each hinge that passes through said tooth by means of internal threading, such as said flange screw being oriented so as to penetrate to the rear of said launching device and into a recess made in said notch in said base, said recess in contact with said flange screw so as to prevent any radial movement of said tooth with respect to said base.

9. The launching device according to claim 8, wherein the surfaces of said recess are selected with dimensions such that they do not interfere with said flange screw when said tooth rotates around said instantaneous axis in the direction of opening of said sectors.

* * * * *